US012129639B2

(12) United States Patent
Kasakawa et al.

(10) Patent No.: US 12,129,639 B2
(45) Date of Patent: Oct. 29, 2024

(54) CHEMICAL SOLUTION SUPPLY DEVICE

(71) Applicant: Kobayashi Pharmaceutical Co., Ltd., Osaka (JP)

(72) Inventors: Kaoru Kasakawa, Osaka (JP); Kouji Nakatani, Osaka (JP); Yuji Nakayama, Tokyo (JP)

(73) Assignee: Kobayashi Pharmaceutical Co., Ltd., Osaka (JP)

( * ) Notice: Subject to any disclaimer, the term of this patent is extended or adjusted under 35 U.S.C. 154(b) by 119 days.

(21) Appl. No.: 17/907,456

(22) PCT Filed: Feb. 10, 2021

(86) PCT No.: PCT/JP2021/004978
§ 371 (c)(1),
(2) Date: Sep. 27, 2022

(87) PCT Pub. No.: WO2021/199698
PCT Pub. Date: Oct. 7, 2021

(65) Prior Publication Data

US 2023/0119847 A1 Apr. 20, 2023

(30) Foreign Application Priority Data

Mar. 31, 2020 (JP) ..... 2020-063560

(51) Int. Cl.
*E03D 9/03* (2006.01)
*E03D 9/00* (2006.01)

(52) U.S. Cl.
CPC ..... *E03D 9/032* (2013.01); *E03D 9/005* (2013.01)

(58) Field of Classification Search
CPC ..... E03D 9/032; E03D 9/033; E03D 9/005
(Continued)

(56) References Cited

U.S. PATENT DOCUMENTS 6,651,261 B1 * 11/2003 Leonard ..... E03D 9/032 4/231
2002/0178493 A1 * 12/2002 Varanasi ..... E03D 9/032 4/223
(Continued)

FOREIGN PATENT DOCUMENTS

CN 211057952 U 7/2020
DE 202019101946 U 5/2019
(Continued)

OTHER PUBLICATIONS

Office Action received in counterpart Japanese Patent Application No. 2020-063560 dispatched on August 1, 2023.
(Continued)

*Primary Examiner* — Huyen D Le
(74) *Attorney, Agent, or Firm* — Knobbe, Martens, Olson & Bear, LLP

(57) ABSTRACT

Provided is a chemical solution supply device for which an installation location can be easily ensured and which can stably supply a chemical solution. The chemical solution supply device includes a container having an inner space in which a chemical solution to be supplied to a toilet bowl is accommodated, and a guide member that is attached to an upper portion of a side wall portion defining a water flow space in which washing water for washing the toilet bowl flows, and has a guide surface in which one or a plurality of grooves for guiding the chemical solution sent out from the inner space to the water flow space are formed.

6 Claims, 6 Drawing Sheets

(58) Field of Classification Search
USPC ..... 4/231
See application file for complete search history.

(56) References Cited

U.S. PATENT DOCUMENTS

| | | | | |
|---|---|---|---|---|
| 2005/0034226 | A1* | 2/2005 | Keramidas | E03D 9/032 4/231 |
| 2009/0077727 | A1* | 3/2009 | Virica | E03D 9/032 4/227.7 |
| 2010/0235976 | A1* | 9/2010 | Cooper | E03D 9/032 4/223 |

FOREIGN PATENT DOCUMENTS

| | | | |
|---|---|---|---|
| JP | 2003-517124 | A | 5/2003 |
| JP | 2008-111296 | A | 5/2008 |
| JP | 2013-079496 | A | 5/2013 |
| JP | 2016-124596 | A | 7/2016 |
| JP | 2017-218234 | A | 12/2017 |
| TW | M467694 | U | 12/2013 |

OTHER PUBLICATIONS

International Search Report in PCT/JP2021/004978 issued Apr. 20, 2021.
Written Opinion of the International Searching Authority in PCT/JP2021/004978 dated Apr. 20, 2021.
Taiwanese Office Action for Application No. 110111661, dated Mar. 26, 2024 (in 9 pages).

* cited by examiner

CHEMICAL SOLUTION SUPPLY DEVICE

TECHNICAL FIELD

The present invention relates to a chemical solution supply device for supplying a chemical solution to a toilet bowl.

BACKGROUND ART

Conventionally, a chemical solution supply device has been known which is installed in a water supply receiving tray for washing hands in the upper portion of a water storage tank of a toilet, and which supplies a chemical solution for cleaning, deodorization, and fragrance to the washing water in the water storage tank (e.g., see Patent Document 1). A discharging tool is also known which discharges a gel-like chemical solution and adheres it like a stamp on the inner surface of a toilet bowl (e.g., see Patent Documents 2 and 3).

CITATION LIST

Patent Literature

Patent Document 1: JP 2013-79496A
Patent Document 2: JP 2016-124596A
Patent Document 3: JP 2017-218234A

SUMMARY OF INVENTION

Technical Problem

A chemical solution supply device such as that of Patent Document 1 cannot be installed if there is no water supply receiving tray for hand washing. Also, even if there is a water supply receiving tray, the chemical solution supply device cannot be installed if, for example, an ornament is placed on the water supply receiving tray. On the other hand, if a discharging tool such as that of Patent Documents 2 and 3 is used, the amount of chemical solution that can be adhered to the inner surface of the toilet bowl with a single stamp is limited, and thus there is a risk that the chemical solution on the inner surface of the toilet bowl will be peeled off by flushing, and the chemical solution cannot be stably supplied.

An object of the present invention is to provide a chemical solution supply device for which an installation location can be easily ensured, and which can stably supply a chemical solution.

Solution to Problem

A chemical solution supply device according to a first aspect of the present invention includes: a container having an inner space in which a chemical solution to be supplied to a toilet bowl is accommodated; and a guide member that is attached to an upper portion of a side wall portion defining a water flow space in which washing water for washing the toilet bowl flows, and has a guide surface in which one or a plurality of grooves for guiding the chemical solution sent out from the inner space to the water flow space are formed.

A chemical solution supply device according to a second aspect of the present invention is the chemical solution supply device according to the first aspect, in which the guide member includes a hooking portion for hooking onto the upper portion of the side wall portion from above.

A chemical solution supply device according to a third aspect of the present invention is the chemical solution supply device according to the first aspect or the second aspect, in which the guide member is attached so as to be sandwiched between the upper portion of the side wall portion and an element that is placed on the upper portion of the side wall portion. The upper portion of the side wall portion is an upper portion of a side wall portion of a tank body included in a water storage tank for storing the washing water and the element is a lid of the tank body included in the water storage tank, or the upper portion of the side wall portion is a rim of the toilet bowl and the element is a toilet seat attached to the toilet bowl.

A chemical solution supply device according to a fourth aspect of the present invention is the chemical solution supply device according to the third aspect, in which the guide member includes a protruding portion that protrudes from the guide surface and receives the element such that the element does not come into contact with the guide surface when the guide member is attached so as to be sandwiched between the upper portion of the side wall portion and the element.

A chemical solution supply device according to a fifth aspect of the present invention is the chemical solution supply device according to any one of the first to fourth aspects, further including a cover member that is attached to the guide member so as to at least partially cover the guide surface while keeping a certain distance from the guide surface.

Advantageous Effects of the Invention

According to the above viewpoints, a guide member having a guide surface in which one or more grooves are formed is used to supply the chemical solution accommodated in the container to the toilet bowl. This guide member is attached to the upper portion of the side wall, which defines a water flow space through which washing water for washing the toilet bowl flows, and the guide member guides the chemical solution sent out from the container to the water flow space via the one or more grooves. Accordingly, the chemical solution supply device can be installed even if there is no water supply receiving tray for washing hands, an ornament is placed on the water supply receiving tray, or the like. Also, the chemical solution in the container can be easily guided to the water flow space via the guide member. Accordingly, it is easy to ensure an installation location for the chemical solution supply device, and the chemical solution can be stably supplied.

DESCRIPTION OF EMBODIMENTS

Hereinafter, a chemical solution supply device according to an embodiment of the present invention will be described with reference to the drawings.

1. Overview of Chemical Solution Supply Device

Figure 1:
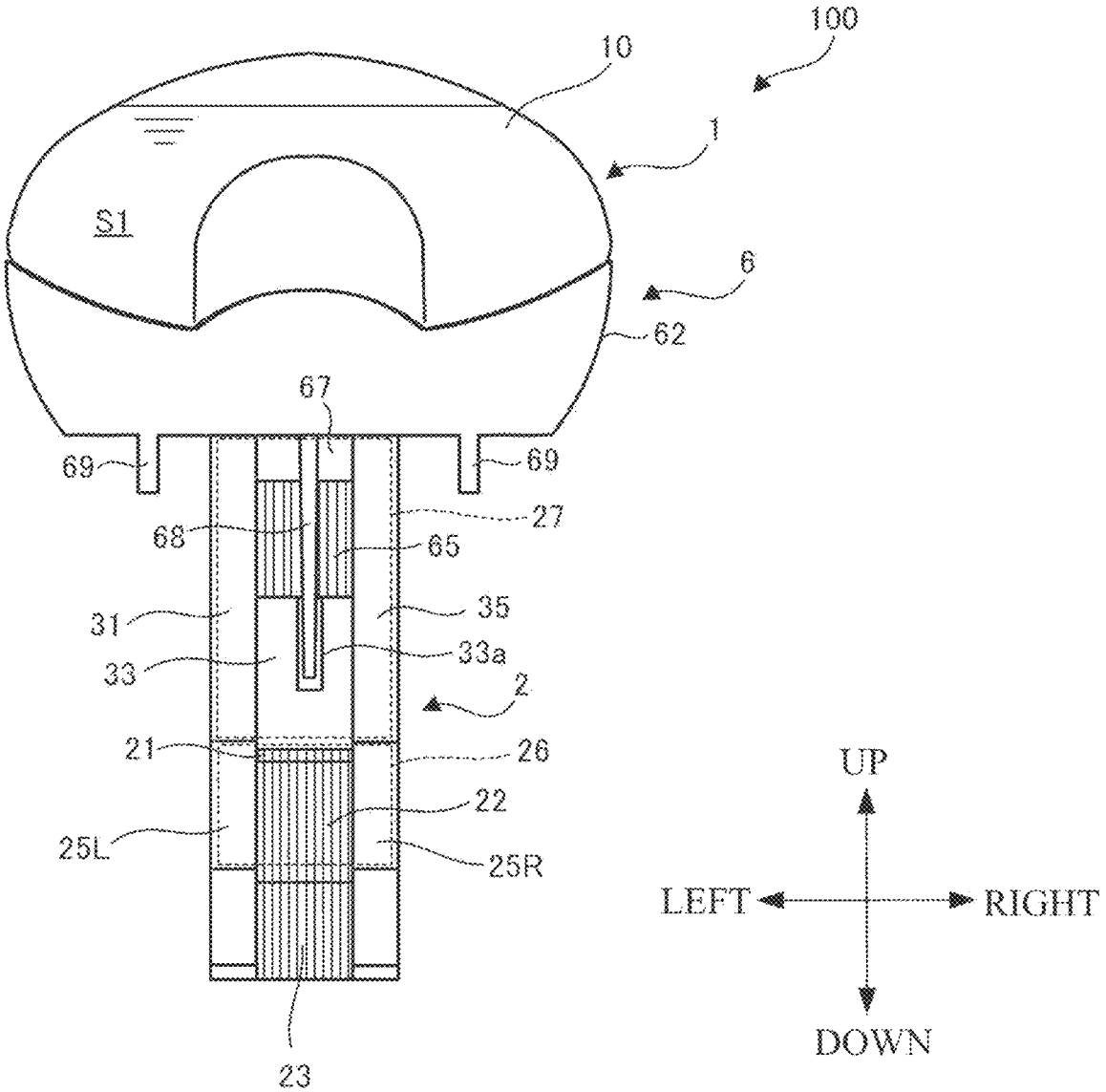
FIG. 1 is a front view of a chemical solution supply device according to an embodiment of the present invention.
Figure 2:
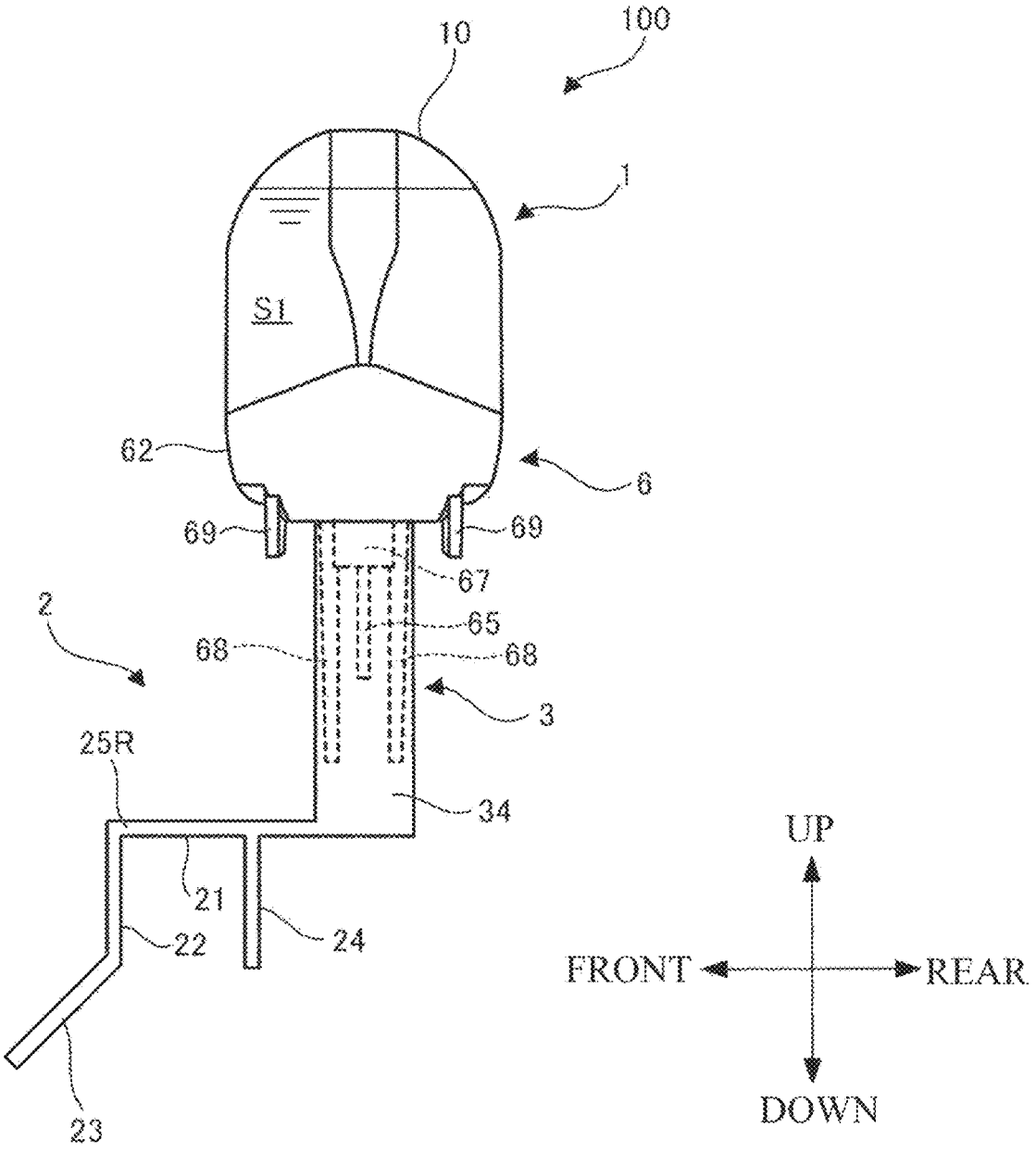
FIG. 2 is a right side view of the chemical solution supply device.
Figure 3A:
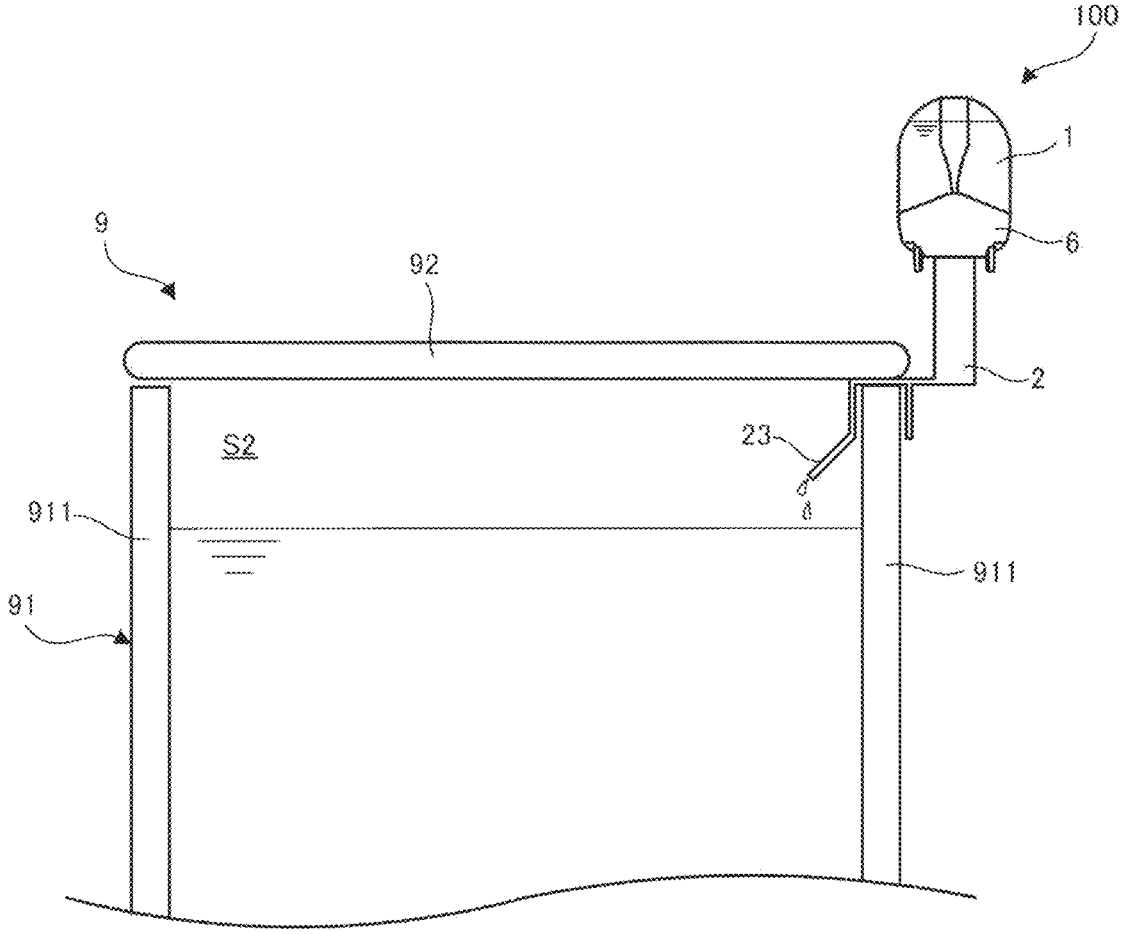
FIG. 3A is a diagram showing an installation example of the chemical solution supply device.
Figure 3B:
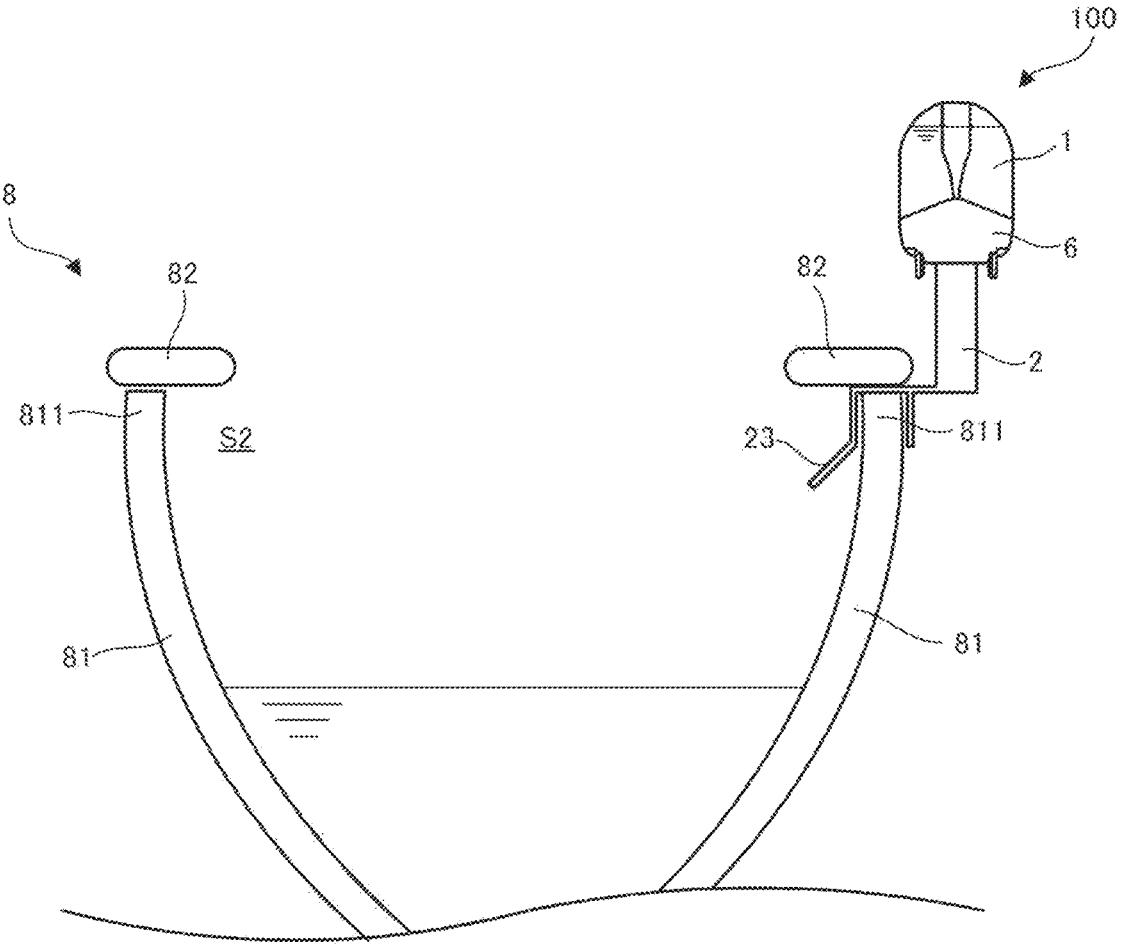
FIG. 3B is diagram showing another installation example of the chemical solution supply device.
Figure 4:
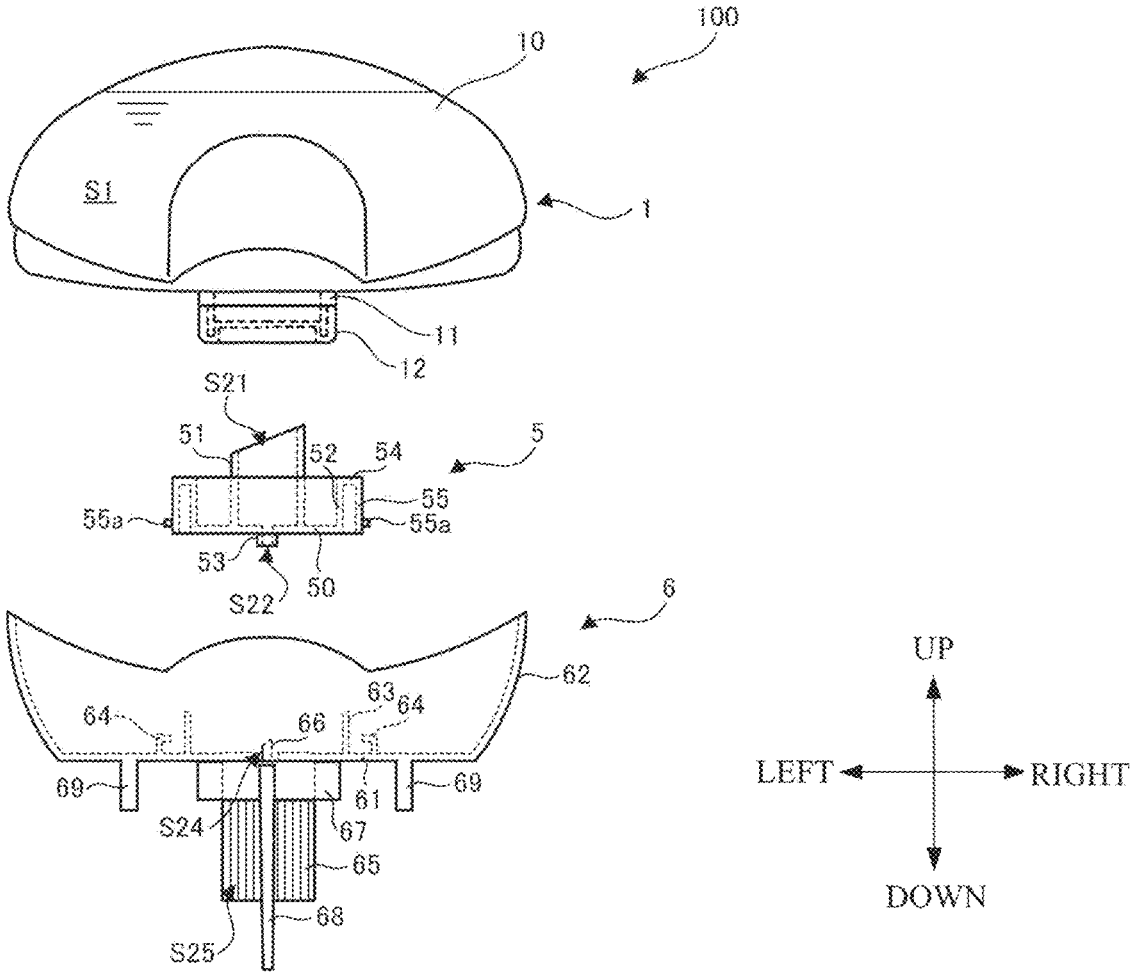
FIG. 4 is an exploded view of a container, a connecting member, and a lower container.

FIG. 1 is a front view of a chemical solution supply device 100 according to an embodiment of the present invention, FIG. 2 is a right side view thereof, and FIGS. 3A and 3B are diagrams showing typical installation examples of the chemical solution supply device 100. The chemical solution supply device 100 is a device for supplying a chemical solution to the toilet bowl of a toilet, and as shown in these drawings, includes a container 1 in which a chemical solution to be supplied to the toilet bowl is accommodated and a guide member 2 connected to the container 1. Note that in the description here, unless otherwise specified, "upper (top surface)", "lower (bottom surface)", "left", "right", "front (front surface)", and "rear (rear surface)" are defined as shown in FIGS. 1, 2, and 4.

As shown in FIGS. 3A and 3B, the chemical solution supply device 100 is installed in the surrounding area of a toilet bowl 8 or in the surrounding area of a water storage tank 9 so as to be able to supply the chemical solution to the inside of the toilet bowl 8 or the inside of the water storage tank 9 that stores washing water for washing the toilet bowl 8. The spaces within the toilet bowl 8 and the water storage tank 9 serve as spaces in which washing water flows, and hereinafter, these spaces may be referred to as a water flow space S2.

The water storage tank 9 includes a tank body 91 with an opening at its upper portion, and a lid 92 covering the opening at the upper portion of the tank body 91. To give a typical installation example of the chemical solution supply device 100, as shown in FIG. 3A, the chemical solution supply device 100 is attached such that the container 1 is arranged on a side of the water storage tank 9, and the guide member 2 is sandwiched between the upper portion of a side wall portion 911 of the tank body 91 and a lid 92 placed on the upper portion of the side wall portion 911. The side wall portion 911 of the tank body 91 defines the water flow space S2. Hereinafter, the upper portion of the side wall portion 911 will be referred to as a first element in some cases, and the lid 92 placed thereon will be referred to as a second element in some cases.

To give another typical installation example of the chemical solution supply device 100, as shown in FIG. 3B, the chemical solution supply device 100 is attached such that the container 1 is arranged on the side of the toilet bowl 8 and the guide member 2 is sandwiched between a rim 811 of the toilet bowl 8 and a toilet seat 82 attached to the toilet bowl 8. The rim 811 of the toilet bowl 8 corresponds to the upper portion of the side wall portion 81 of the toilet bowl 8, and the toilet seat 82 is placed on the rim 811. The side wall portion 81 of the toilet bowl 8 defines the water flow space S2. Hereinafter, the rim 811 of the toilet bowl 8 will also be referred to as the first element in some cases, and the toilet seat 82 placed thereon will also be referred to as the second element in some cases. As described above, the guide member 2 is attached to a predetermined installation location so as to be sandwiched between the first element and the second element.

The chemical solution supply device 100 of this embodiment further includes a connecting member 5 and a lower container 6 that are arranged between the container 1 and the guide member 2 (see FIG. 4). The guide member 2 is indirectly connected to the container 1 via the connecting member 5 and the lower container 6. Although the details will be described later, the connecting member 5 and the lower container 6 as a whole play a role of controlling the supply amount of the chemical solution from the container 1.

The chemical solution contains one or more elements selected from the group including detergents, disinfectants, deodorants, and fragrances, and may also contain colorants. The chemical solution is mixed with the washing water to provide the effect of the components contained in the chemical solution to the inside of the toilet bowl or the inside of a toilet room. For example, if the chemical solution contains a detergent and a disinfectant, it can wash and disinfect the toilet bowl, and if it contains a deodorant and a fragrance, it can eliminate unpleasant odors in the toilet room and give off a pleasant scent.

2. Configuration of Each Portion 2-1. Container

FIG. 4 is an exploded view of the container 1, the connecting member 5, and the lower container 6. As shown in FIG. 4, the container 1 has a container body 10 having an inner space S1 in which a chemical solution is accommodated, and a cap 12 closing the inner space S1. The shape of the container body 10 is not particularly limited, but in the present embodiment, it has a dome shape that is wider in the left-right direction than in the depth direction and is slightly flattened in the left-right direction.

The container body 10 has an outlet portion 11 at the center of the lower portion thereof, which causes the inner space S1 and an outer space to be in communication with each other, and the outlet portion 11 has a cylindrical shape extending in the vertical direction. The cap 12 is fixed to the outlet portion 11 so as to cover and close the outlet portion 11. In FIG. 4, for reference, a cross section of the outlet portion 11 and the cap 12 taken along a plane that passes through the central axis of the outlet portion 11 and is parallel to the left-right direction is partially indicated by dotted lines.

The material constituting the container 1 is not particularly limited, but typically, hard resin or metal can be used thereas. For example, the container body 10 can be preferably made of synthetic resin such as polyethylene terephthalate, polyethylene, and polypropylene. The same applies to the cap 12 as well.

2-2. Connecting Member

As shown in FIG. 4, the connecting member 5 has a circular plate-shaped base 50 and a cylindrical piercing portion 51 standing up from the center of the upper surface of the base 50. Note that in FIG. 4, for reference, cross sections of the connecting member 5 and the lower container 6 taken along a plane that passes through the central axis of the piercing portion 51 and is parallel to the left-right direction are partially indicated by dotted lines. The piercing portion 51 has a shape obtained by obliquely cutting the upper portion of a cylinder extending in the vertical direction, and the upper portion thereof is sharp. The piercing portion 51 is inserted into the outlet portion 11 so as to pierce the bottom surface of the cap 12 of the container 1 from below. The connecting member 5 further has a cylindrical peripheral wall portion 52, and the peripheral wall portion 52 is spaced apart from the piercing portion 51 and rises upward from the outer peripheral edge of the base 50 so as to surround the piercing portion 51. An annular space surrounded by the outer surface of the piercing portion 51 and the inner surface of the peripheral wall portion 52 receives the cap 12 and the outlet portion 11 of the container 1.

Also, the connecting member 5 further has a cylindrical port member 53 that hangs down from the center of the lower surface of the base 50. A minute opening is formed in the center of the base 50, and the port member 53 is arranged so as to surround the opening. Accordingly, a space S21 inside the piercing portion 51 is in communication with a space S22 inside the port member 53. Note that the port member 53 has a smaller diameter than the piercing portion 51.

The connecting member 5 further has an annular top surface portion 54 that is continuous with the upper edge of the peripheral wall portion 52 and extends radially outward from the upper edge. The outer peripheral edge of the top surface portion 54 is rectangular. Also, the connecting member 5 further has a peripheral wall portion 55 that hangs down from the outer peripheral edge of the top surface portion 54. The peripheral wall portion 55 has a rectangular cylinder shape. A pair of left and right protrusions 55*a* protrude radially outward from the vicinity of the lower portions of the left wall portion and the right wall portion of the peripheral wall portion 55. These protrusions 55*a* connect the lower container 6 and the connecting member 5 by hooking onto a pair of left and right claw portions 64 of the lower container 6, which will be described later.

The material constituting the connecting member 5 is not particularly limited, but typically, hard resin or metal can be used thereas. For example, the connecting member 5 can be preferably made of synthetic resin such as polypropylene, polyethylene, and polyethylene terephthalate.

2-3. Lower Container

The lower container 6 is a dish-shaped container that receives the lower portion of the container 1 including the outlet portion 11 and the cap 12 from below and accommodates the lower portion of the container 1. The lower container 6 has a bottom surface portion 61 and an outer wall portion 62 that rises upward, outward from the bottom surface portion 61. Inside the outer wall portion 62, the lower container 6 further has a rectangular cylinder-shaped peripheral wall portion 63 standing up from the upper surface of the bottom surface portion 61, and the space inside the peripheral wall portion 63 accommodates the connecting member 5. At this time, the peripheral wall portion 63 is received in a rectangular loop-shaped space surrounded by the outer surface of the peripheral wall portion 52 and the inner surface of the peripheral wall portion 55 of the connecting member 5. On the upper surface of the bottom surface portion 61, a pair of left and right claw portions 64 stand up from positions spaced from the peripheral wall portion 63 to the left and right. These claw portions 64 are hooked onto the protrusions 55*a* of the connecting member 5 described above, thereby fixing the lower container 6 to the connecting member 5. Accordingly, the lower container 6 does not accidentally fall off of the connecting member 5.

The lower container 6 further has a plate member 65 hanging down from the center of the lower surface of the bottom surface portion 61. The width direction of the plate member 65 extends in the left-right direction, and the thickness direction extends in the front-rear direction. A cylindrical protrusion 66 rises from the center of the upper surface of the plate member 65. An opening is formed in the center of the bottom surface portion 61. The protrusion 66 extends vertically so as to pass through the opening in the center of the bottom surface portion 61. The protrusion 66 has a shape obtained by obliquely cutting the upper portion of a cylinder extending in the vertical direction, and the upper portion is sharp. A large number of fine grooves S25 extending in the vertical direction are formed on the front and rear surfaces of the plate member 65.

The protrusion 66 is inserted into the space S22 inside the port member 53 when the connecting member 5 is accommodated in the space inside the peripheral wall portion 63 and the lower container 6 and the connecting member 5 are connected to each other. A fine groove S24 extending in the vertical direction is formed on the outer surface of the protrusion 66 over the entire length of the protrusion 66. Accordingly, when the lower container 6 and the connecting member 5 are connected to each other, the piercing portion 51 punctures the cap 12, and the container 1 and the connecting member 5 are connected to each other, the fine groove S24 is in communication with the inner space S1 of the container 1. More specifically, the fine groove S24 is in communication with the inner space S1 of the container 1 via the space S21 inside the piercing portion 51, and serves as a passage through which the chemical solution sent out from the inner space S1 flows.

After passing through the fine groove S24, the chemical solution sent out from the inner space S1 reaches the plate member 65 below the protrusion 66 and flows into the fine groove S25 of the plate member 65. At this time, the chemical solution flows from the inner space S1 into the fine grooves S24 at a slow speed, and flows further into the fine grooves S25 due to capillary action as well as gravity. After flowing along the fine grooves S25 of the plate member 65 and reaching the lower end thereof, the chemical solution drops from the plate member 65 and is received by the guide member 2. The fine groove S25 also serves as a passage through which the chemical solution sent out from the inner space S1 flows. Accordingly, the front and rear surfaces of the plate member 65 in which the fine grooves S25 are formed constitute guide surfaces that guide the chemical solution sent out from the inner space S1 of the container 1 toward the water flow space S2.

The lower container 6 further has a rectangular cylinder-shaped peripheral wall portion 67, and the peripheral wall portion 67 is spaced apart from the plate member 65 and hangs down from the lower surface of the bottom surface portion 61 so as to surround the plate member 65. A pair of front and rear rods 68 extending in the vertical direction are arranged at the center of the front surface and the center of the rear surface of the peripheral wall portion 67. The pair of front and rear rods 68 are used for positioning the lower container 6 with respect to the guide member 2, although the details will be described later.

Also, the lower container 6 further has a support portion 69 extending downward from the outer wall portion 62. In this embodiment, the support portion 69 is composed of a plurality of legs. These legs extend in the vertical direction, and two of these legs are arranged in the lower portion of the front surface of the outer wall portion 62 at a certain interval in the left-right direction, and two of them are further arranged at the lower portion of the rear surface of the outer wall portion 62 at a certain interval in the left-right direction.

In the example of FIGS. 3A and 3B, the guide member 2 is arranged below the lower container 6, and the container 1 is installed on the side of the water storage tank 9 or the toilet bowl 8 via the guide member 2. However, if the lid 92 has a water supply receiving tray for hand washing, the container 1 can be installed on the water supply receiving tray using only the connecting member 5 and the lower container 6, without using the guide member 2. At this time, the pair of front and rear rods 68 are inserted together with the plate member 65 into the opening formed in the water supply receiving tray through which the washing water flows into the water storage tank 9. Also, at this time, the plurality of legs constituting the support portion 69 are installed so as to stand on the water supply receiving tray. The support portion 69 supports the container 1 so that the container 1 is stably installed in the water supply receiving tray.

As described above, the connecting member 5 and the lower container 6 receive the chemical solution from the inner space S1 of the container 1 and supply the chemical solution to the guide member 2. These elements 5 and 6 can control the supply amount of the chemical solution from the container 1 by appropriately adjusting the cross-sectional areas of the fine grooves S24 and S25 through which the chemical solution passes, and thus the chemical solution is stably supplied with a desired flow rate into the guide member 2 further downstream, and eventually into the water flow space S2.

Although the material constituting the lower container 6 is not particularly limited, typically, hard resin or metal can be used thereas. For example, the lower container 6 can be preferably made of synthetic resin such as polypropylene, polyethylene, and polyethylene terephthalate.

2-4. Guide Member

The guide member 2 is a member that guides the chemical solution sent out from the inner space S1 of the container 1 to the water flow space S2. The guide member 2 is attached to the first element. As described above, the first element means the upper portion of the side wall portion that defines the water flow space S2, and for example, means the upper portion of the side wall portion 911 of the tank body 91 or the rim 811 of the toilet bowl 8. Also, the guide member 2 is installed so as to be sandwiched between the first element and the second element. As described above, the second element means the element placed on top of the first element, and for example, means the lid 92 of the water tank 9 or the toilet seat 82.

Figure 5:
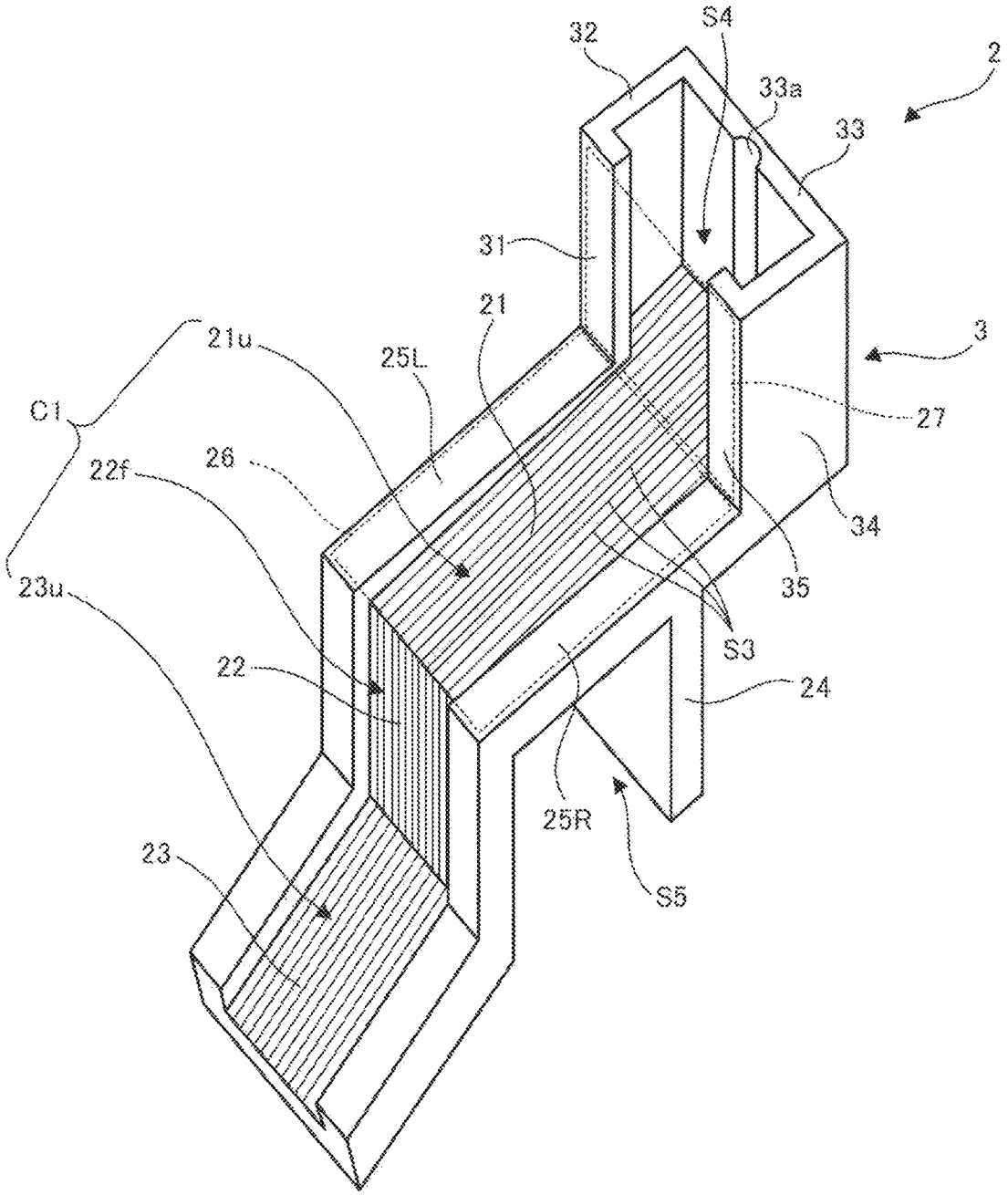
FIG. 5 is a perspective view of a guide member viewed obliquely from above.

FIG. 5 is a perspective view of the guide member 2 viewed obliquely from above. As shown in FIG. 5, the guide member 2 has a joining portion 3, a first guide plate 21, a second guide plate 22, a third guide plate 23, and a facing plate 24, and is shaped like a chair overall. The first guide plate 21 extends forward and is inclined slightly downward toward the front when the chemical solution supply device 100 is in use. The second guide plate 22 extends downward from the front end of the first guide plate 21. The third guide plate 23 extends forward and downward from the lower end of the second guide plate 22. The facing plate 24 extends downward from the first guide plate 21 at a certain distance rearward from the second guide plate 22. The joining portion 3 is a frame that stands upright from the rear end portion of the first guide plate 21 and receives the lower portion of the lower container 6. The joining portion 3 is a part to which the lower container 6 is joined.

An upper surface 21*u* of the first guide plate 21, a front surface 22*f* of the second guide plate 22, and an upper surface 23*u* of the third guide plate 23 are continuous in this order, and the chemical solution received from the lower container 6 joined to the joining portion 3 is transported on these surfaces 21*u*, 22*f*, and 23*u*. These surfaces 21*u*, 22*f*, and 23*u* will be hereinafter referred to as a guide surface C1. On the guide surface C1, the upper surface 21*u* of the first guide plate 21 corresponds to the upstream side, and the upper surface 23*u* of the third guide plate 23 corresponds to the downstream side along the flow of the chemical solution. Hereinafter, the direction from the upper surface 21*u* to the front surface 22*f* and from the front surface 22*f* to the upper surface 23*u* will be referred to as the transport direction in some cases.

A large number of fine grooves S3 are formed on the guide surface C1 to guide the chemical solution sent out from the inner space S1 of the container 1 to the water flow space S2 along the transport direction. The fine grooves S3 continuously extend along the transport direction on the guide surface C1.

The joining portion 3 has a left column portion 31, a left wall portion 32, a rear wall portion 33, a right wall portion 34, and a right column portion 35. The left column portion 31 is a columnar portion that slightly protrudes rightward from the front edge of the left wall portion 32, and the right column portion 35 is a columnar portion that slightly protrudes leftward from the front edge of the right wall portion 34. These portions 31 to 35 are continuous in this order in a clockwise direction in a plan view, and overall have a rectangular cylinder shape with the center on the front side cut off. The space S4 enclosed by these portions 31 to 35 receives the lower portion of the lower container 6 when the lower container 6 is connected to the guide member 2. More specifically, the plate member 65, the peripheral wall portion 67, and the pair of front and rear rods 68 are accommodated in the space S4. At this time, the bottom surface portion 61 of the lower container 6 comes into contact with the upper surface of the joining portion 3 and is placed on the upper surface. Note that, for reference, in FIG. 2, cross sections of the plate member 65, the peripheral wall portion 67, and the pair of front and rear rods 68 taken along a plane that passes through the central axis of the plate member 65 and is parallel to the front-rear direction are partially indicated by dotted lines.

A recess 33*a* extending in the vertical direction is formed in the center in the left-right direction of the front surface of the rear wall portion 33. When the lower container 6 is connected to the guide member 2, the rear rod 68 of the pair of front and rear rods 68 is accommodated in the recess 33*a*. As a result, the plate member 65, the peripheral wall portion 67, and the pair of front and rear rods 68 are positioned within the space S4, and as a result, the position of the lower container 6 with respect to the guide member 2, and consequently the position of the container 1 accommodated therein, are stabilized. Note that as shown in FIGS. 1 and 2, when the lower container 6 is connected to the guide member 2, the plurality of legs forming the support portion 69 of the lower container 6 are arranged outside the space S4 at positions that do not interfere with the joining portion 3.

The guide surface C1 is arranged below the space S4, and the region facing the space S4 on the guide surface C1 is the most upstream portion. As described above, after being sent out from the inner space S1 of the container 1, the chemical solution traces various routes and reaches the fine grooves S25 of the plate member 65 accommodated in the space S4. Thereafter, the chemical solution flows downward along the fine groove S25 and falls from the fine grooves S25 to the most upstream portion on the guide surface C1. The chemical solution is sucked into and caught in a large number of fine grooves S3 at this most upstream portion. Thereafter, the chemical solution flows downstream along the transport direction at a slow speed in the fine grooves S3 due to capillary action as well as gravity. As shown in FIGS. 3A and 3B, when the chemical solution supply device 100 is in use, the third guide plate 23 is accommodated in the water flow space S2. Accordingly, after flowing to the front edge of the third guide plate 23, which is the downstream end of the guide surface C1, the chemical solution drops from the upper surface 23*u* of the third guide plate 23, and is mixed with the washing water in the water flow space S2.

The facing plate 24 is arranged so as to face the second guide plate 22 at a certain distance rearward of the second guide plate 22. An upper side of a space S5 between the second guide plate 22 and the facing plate 24 is closed by the first guide plate 21. On the other hand, the lower side of the space S5 is open. As a result, when the chemical solution supply device 100 is used, the first element described above is inserted into the space S5 from below. At this time, the lower surface of the first guide plate 21 comes into contact with the first element and is placed on the first element.

As described above, when the chemical solution supply device 100 is used, the guide member 2 is hooked onto the first element from above. After being installed as described above, the guide member 2 will not fall off rearward due to the second guide plate 22 and will not fall off forward due to the facing plate 24. That is, the second guide plate 22 and the facing plate 24 constitute a hooking portion for hooking the guide member 2 onto the first element from above. Accordingly, when the chemical solution supply device 100 is used, the position of the guide member 2, and consequently the position of the container 1 supported by the guide member 2 via the lower container 6 are stabilized.

The guide member 2 further has ribs (protruding portions) 25L and 25R that protrude upward from the guide surface C1. The ribs 25L and 25R stand upward from the left end and the right end of the guide surface C1, respectively. Also, the ribs 25L and 25R extend respectively from the left column portion 31 and the right column portion 35 of the joining portion 3 to the front edge of the first guide plate 21 along the transport direction. The ribs 25L and 25R on the first guide plate 21 can function as stoppers that prevent the chemical solution from dropping from the left and right sides of the guide surface C1.

As described above, when the chemical solution supply device 100 is used, the guide member 2 is sandwiched between the first element and the second element. At this time, the first guide plate 21 is sandwiched between the first element and the second element. The ribs 25L and 25R on the first guide plate 21 receive the second element so as to prevent the second element from coming into contact with the guide surface C1 when the first guide plate 21 is sandwiched between the first element and the second element. As a result, the ribs 25L and 25R on the first guide plate 21 can prevent the flow of the chemical solution on the guide surface C1 from being hindered due to the weight of the second element acting on the guide surface C1, and the fine grooves S3 being deformed and compressed.

In this embodiment, the upper surfaces of the ribs 25L and 25R on the first guide plate 21 are flush with each other and constitute a horizontal or substantially horizontal surface. As a result, the ribs 25L and 25R can uniformly bear the weight of the second element, and the strength of the guide member 2 including the first guide plate 21 is increased. Note that, as described above, the first guide plate 21 is inclined slightly downward toward the front. For this reason, on the first guide plate 21, the distance between the upper surface 21*u* and the upper surfaces of the ribs 25L and 25R gradually increases along the transport direction.

The distance from the upper surface 21*u* of the first guide plate 21 to the upper surfaces of the ribs 25L and 25R is preferably 5.0 mm or less. In this case, rattling between the first element and the second element can be suppressed when the guide member 2 is attached so as to be sandwiched between the first element and the second element.

Also, in this embodiment, the ribs 25L and 25R extend not only on the first guide plate 21, but also on the second guide plate 22 and the third guide plate 23.

The material constituting the guide member 2 is not particularly limited, but typically, hard resin or metal can be used thereas. For example, the guide member 2 can be preferably made of synthetic resin such as polypropylene, polyethylene, and polyethylene terephthalate.

Also, cover members 26 and 27 are attached to the guide member 2. The cover members 26 and 27 are indicated by dotted lines in FIGS. 1 and 5 so that other elements can be easily seen. The cover member 26 is a member arranged so as to cover the guide surface C1 while keeping a certain distance from the guide surface C1. The cover member 26 is a sheet-like member, is attached to the ribs 25L and 25R on the first guide plate 21, and extends planarly therebetween. On the other hand, the cover member 27 is also a sheet-like member, is attached to the left column portion 31 and the right column portion 35, and extends planarly therebetween. The cover members 26 and 27 prevent dust and the like from adhering to the guide plate C1, which serves as a passage for the chemical solution, and prevent the flow of the chemical solution in the fine grooves S3 from being hindered. Note that the cover members 26 and 27 can be formed in various shapes as long as they can fulfill such functions.

Although the material constituting the cover members 26 and 27 is not particularly limited, typically, resin or paper can be used thereas.

According to the guide member 2 described above, it is easier to ensure an installation location of the chemical solution supply device 100, even if there is no water supply receiving tray for washing hands on the lid 92 of the water storage tank 9, an ornament is placed on the water supply receiving tray, or the like. Also, according to the guide member 2, the chemical solution in the container 1 can be easily guided to the water flow space S2, and the chemical solution can be stably supplied.

3. Modified Examples

Although one embodiment of the present invention has been described above, the present invention is not limited to the above-described embodiment, and various modifications are possible without departing from the spirit of the invention. For example, the following modifications are possible. Also, the gists of the following modified examples can be combined as appropriate.

3-1

In the above-described embodiment, the container 1 was installed on the side of the water storage tank 9 or the side of the toilet bowl 8. However, the container 1 can be installed in various locations by appropriately routing the guide surface C1 of the guide member 2. For example, the container 1 can be arranged on the flat upper surface of the lid 92 of the water storage tank 9.

3-2

In the above-described embodiment, the connecting member 5 and the lower container 6 may be omitted, and the guide member 2 may be directly connected to the outlet portion 11 of the container 1. In this case, for example, the guide surface C1 of the guide member 2 may be connected to the outlet portion 11 by appropriately routing the guide surface C1.

3-3

In the above-described embodiment, the ribs 25L and 25R may be omitted from the guide member 2. In this case, in order to prevent the flow of the chemical solution in the fine groove S3 from being hindered, it is preferable to prepare a spacer separate from the guide member 2, and place this spacer in the vicinity of the guide member 2 so as to be sandwiched between the first element and the second element.

In addition to the ribs 25L and 25R, other ribs may be further arranged on the guide surface C1. For example, on the guide surface C1, a rib extending along the transport direction may be arranged at the central portion in the left-right direction.

3-4

The number of grooves formed on the guide surface C1 is not particularly limited, and may be a large number as in the example of the fine grooves S3 described above, or may be only one.

3-5

The attachment positions of the cover members that cover the guide surface C1 are not limited to the examples of the cover members 26 and 27 described above. For example, only the upper portion of the first guide plate 21 may be covered.

LIST OF REFERENCE NUMERALS

100 Chemical solution supply device
1 Container
2 Guide member
21 First guide plate
22 Second guide plate (hooking portion)
23 Third guide plate
24 Facing plate (hooking portion)
25L, 25R Rib (protruding portion)
26, 27 Cover member
8 Toilet bowl
81 Side wall portion
811 Rim
82 Toilet seat
9 Water storage tank
91 Tank body
911 Side wall portion
92 Lid
S1 Inner space
S2 Fluid space
S3 Fine groove
C1 Guide surface

The invention claimed is:

1. A chemical solution supply device comprising:

a container having an inner space in which a chemical solution to be supplied to a toilet bowl is accommodated; and a guide member that is attached to an upper portion of a side wall portion defining a water flow space in which washing water for washing the toilet bowl flows, and has a guide surface in which one or a plurality of grooves for guiding the chemical solution sent out from the inner space to the water flow space are formed, wherein the guide member is attached so as to be sandwiched between the upper portion of the side wall portion and an element that is placed on the upper portion of the side wall portion, and the upper portion of the side wall portion is an upper portion of a side wall portion of a tank body included in a water storage tank for storing the washing water and the element is a lid of the tank body included in the water storage tank, or the upper portion of the side wall portion is a rim of the toilet bowl and the element is a toilet seat attached to the toilet bowl.

2. The chemical solution supply device according to claim 1, wherein the guide member includes a hooking portion for hooking onto the upper portion of the side wall portion from above.

3. The chemical solution supply device according to claim 2, further comprising a cover member that is attached to the guide member so as to at least partially cover the guide surface while keeping a certain distance from the guide surface.

4. The chemical solution supply device according to claim 1, wherein the guide member includes a protruding portion that protrudes from the guide surface and receives the element such that the element does not come into contact with the guide surface when the guide member is attached so as to be sandwiched between the upper portion of the side wall portion and the element.

5. The chemical solution supply device according to claim 4, further comprising a cover member that is attached to the guide member so as to at least partially cover the guide surface while keeping a certain distance from the guide surface.

6. The chemical solution supply device according to, further comprising a cover member that is attached to the guide member so as to at least partially cover the guide surface while keeping a certain distance from the guide surface.

* * * * *